United States Patent [19]

Wang

[11] Patent Number: 4,873,733

[45] Date of Patent: Oct. 17, 1989

[54] TOY BED

[76] Inventor: Ted T. H. Wang, Room 401, 168, Chung Cheng 4 Road, Kaohsiung, Taiwan

[21] Appl. No.: 188,698

[22] Filed: May 5, 1988

Related U.S. Application Data

[63] Continuation-in-part of Ser. No. 947,722, Dec. 30, 1986, abandoned.

[51] Int. Cl.[4] ..... A47D 7/00

[52] U.S. Cl. ..... 5/93 R; 5/419; 446/71

[58] Field of Search ..... 5/93 R, 97, 98 R, 99 C, 5/113, 121, 280, 414, 416; 135/120; 446/71, 126, 478, 487; D6/331, 388, 389

[56] References Cited

U.S. PATENT DOCUMENTS

| | | | |
|---|---|---|---|
| D. 250,687 | 1/1979 | Robelen | 5/414 |
| D. 252,608 | 8/1979 | Carter | D6/388 |
| D. 264,773 | 6/1982 | Sutherland | 5/53 R |
| 1,395,158 | 10/1921 | Smith | 5/414 X |
| 2,690,186 | 9/1954 | Ball | 5/414 |
| 3,165,760 | 1/1965 | Abajian | 5/98 R X |
| 3,188,661 | 6/1965 | Rudy | 5/97 |
| 3,814,058 | 6/1974 | Thompson | 5/414 |
| 3,837,019 | 9/1974 | Hoff | 5/98 R X |
| 4,081,868 | 4/1978 | Hall | 5/12 R |
| 4,590,956 | 5/1986 | Griesenbeck | 5/113 |
| 4,765,006 | 8/1988 | Jackson et al. | 446/478 |

*Primary Examiner*—Gary L. Smith
*Assistant Examiner*—Michael F. Trettel
*Attorney, Agent, or Firm*—Varndell Legal Group

[57] ABSTRACT

This invention concerns a new toy bed which is made to have a shape mimicking that of a practical object, such as a locomotive, a car, a ship, a tank, etc., to arouse a child's curiosity. For example, when it has a shape of a locomotive, it consists of three main parts, a frame, a mattress and a cover.

The frame is assembled with tubes and joints, having a shape mimicking that locomotive, and the mattress is placed in the frame and surrounded by the framework, so that the frame can steadily be stabilized on the ground. The cover, made of a kind of soft material and having the same shape as the frame, is finally placed around the frame to complete this bed.

9 Claims, 2 Drawing Sheets

TOY BED

This application is a continuation-in-part of application Ser. No. 947,722, filed Dec. 30, 1986, now abandoned.

BACKGROUND OF THE INVENTION

The principal planning of conventional toy beds concentrates on decorative pictures of various kinds of cars, animals, etc. on the flat surface of a bed that may arouse a child's curiosity. This kind of decorative toy bed only gives an appearance in one dimension, not in three dimensions. Such toy beds are quite limited in shapes and styles. Accordingly, the inventor developed the present invention of new toy beds which mimic shapes of locomotives, cars, ships, submarines, tanks, etc. in order to attract children. The toy bed according to the present invention, in addition to having a shape which attracts children, provides a device with which a child can play or amuse himself for a long period of time.

SUMMARY OF THE INVENTION

The present invention is directed to a new toy bed which is made to have a shape, such as that mimicking a locomotive, a car, a ship, etc., having a frame constructed with tubes and joints combined together to represent the form of a practical object. A cover made of soft material, such as plastic leather, real leather, cloth, etc., envelops the frame, which pushes the cover a little outwardly to make up this toy bed.

DETAILED DESCRIPTION OF THE INVENTION

Figure 1:
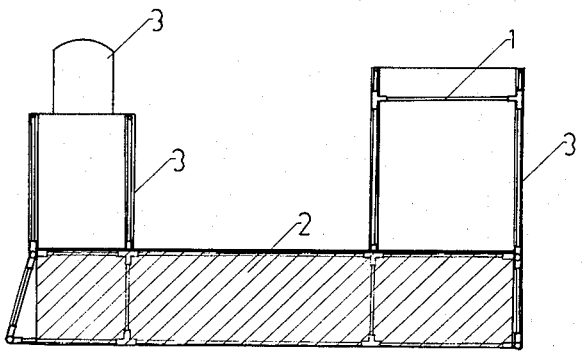
FIG. 1 is a cross-sectional view of an example of this invention.
Figure 2:
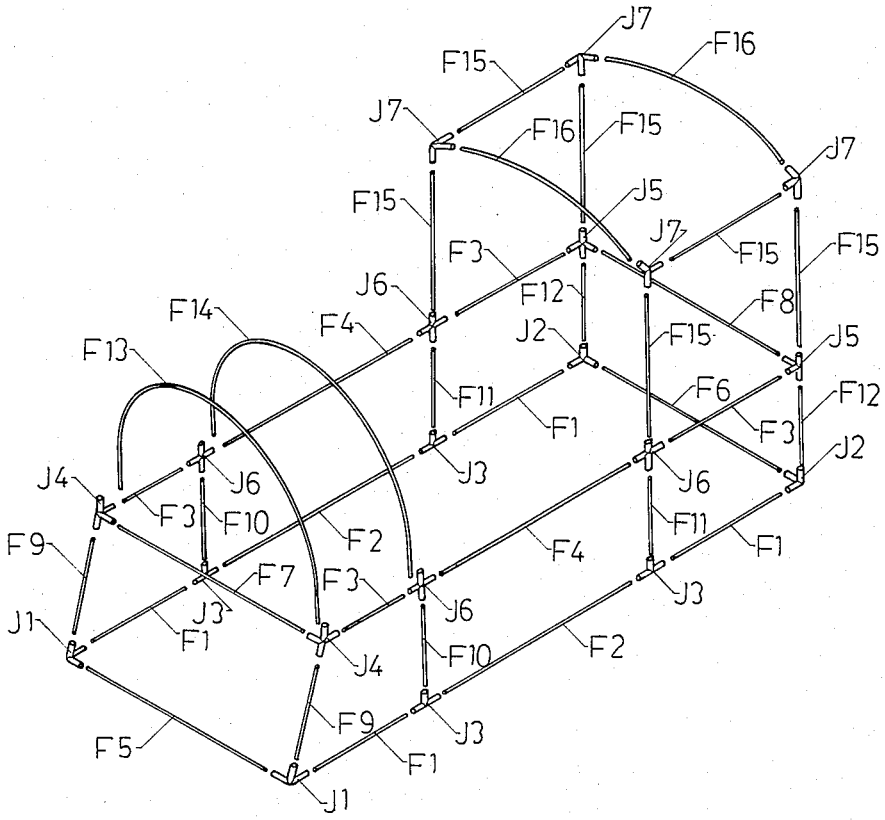
FIG. 2 is an explosive perspective view of the frame of the example of this invention.
Figure 4:
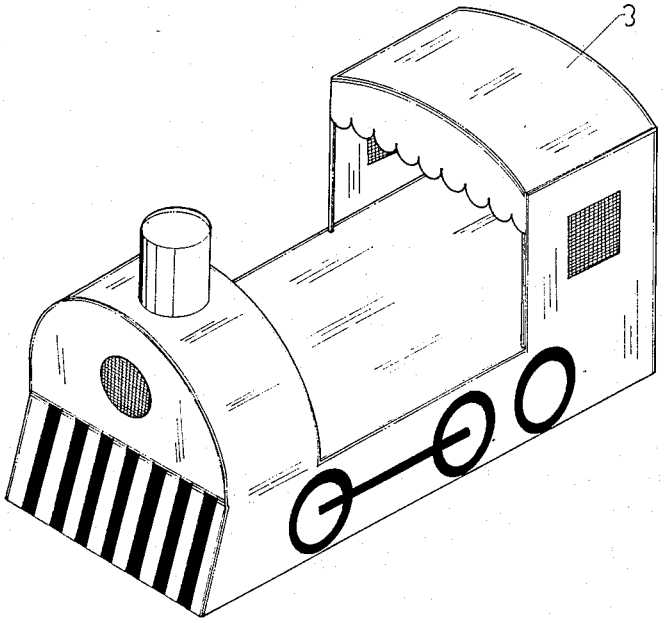
FIG. 4 is an outward view of the example of this invention.

The present invention, a new toy bed, can be made into various kinds of shapes, such as a locomotive, a car, a tank, a submarine, etc., and here it is shaped as a locomotive as an example. As shown in FIG. 1, the new toy bed of the present invention consists of frame 1, mattress 2, and soft cover 3. Frame 1 is assembled with tubes and joints, as shown in FIG. 2. The present invention can mimic the shape of a locomotive and soft cover 3 made of a kind of soft material, such as leather, plastic leather cloth, etc., which envelopes frame 1, as shown in FIG. 4. Soft cover 3 can be made of a single sheet of material. Preferably, frame 1 pushes cover 3 outward. This provides a tight fit between the frame 1 and the cover 3 and adds stability to the toy bed of the present invention.

Figure 3:
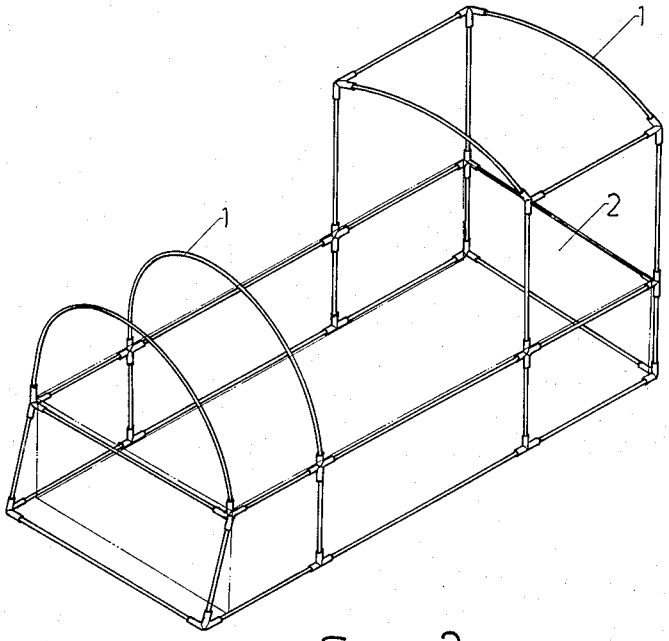
FIG. 3 is a view of the assembled frame of the example of this invention.

FIG. 3 shows the combined relationship of frame 1 and mattress 2, and FIG. 2 shows how frame 1 is assembled with tubes and joints. In assembling the frame of this new toy bed, as a general method, its frame tubes can be long, short, straight or bent and its joints can be straight, cross, trident or quaternary, changable according to the planned shape of the toy bed. The example used here is a locomotive as shown in FIG. 2. First, two short frame tubes F1 and one long frame tube F2 are combined horizontally together with trident joints J1, J2 and two tee joints J3 as a means for sitting on the ground. Next, two short frame tubes F3 and one long frame tubes F4 are combines horizontally together with two quaternary joints J4, J5 and two cross joints along the lengthwise upper sides of mattress 2. Then two long frame tubes F5, F6 are combined between each set of trident joints J1, J2 for supporting the lateral sides of mattress 2 and sitting on the ground. Besides, two long frame tubes F7, F8 are combined between two quaternary joints J4, J5 symmetrically located for supporting the lateral upper sides of mattress 2.

Four short frame tubes F9, F10, F11, F12, as the vertical framework, are combined between two sets of trident joints J1 and quaternary joints J4, between two sets of tee joints J3 and cross joints J6, and between trident joint J2 and quaternary joint J5. Therefore, mattress 2 can completely be surrounded by frame 1, which can steadily be kept in place because of mattress 2.

One semi-circular frame tube F13 is combined between two symmetrical quaternary joints J4, and one semi-circular frame tube F14 is also combined between two symmetrical joints J6; these two frame tubes F13, F14 make up the framework of the front part (a chimney) of a locomotive. Next, six short frame tubes F15 are combined between two symmetrical quaternary joints J5 and two symmetrical trident joints J7, between two symmetrical cross joints J6 and two symmetrical trident joints J7, and between two sets of trident joints J7; two little-bending frame tubes F16 are combined between two lengthwise symmetrical trident joints J7; this framework makes up the rear part of a locomotive.

Lastly, soft cover 3 made to have the same shape as frame 1 is put around frame 1 to become a new toy bed with a locomotive shape.

If the framework is wanted to be foldable, the four frame tubes F5, F6, F7, F8 are to be made foldable at their middle points. Then the frame can be folded down into half the size by removing the four frame tubes F13, F16, F10. This is also one of the advantage of this invention.

What is claimed is:

1. An assembled toy bed, which comprises a frame, mattress and cover, the frame comprising tubes and joints, each tube having two ends and each joint having at least two openings for receiving the ends of the tubes, the joints combining the tubes together to form a rigid three dimensional structure having a shape mimicking one of a locomotive, car, ship, submarine and tank, the mattress being tightly surrounded by the frame and stabilizing the frame, and the cover being made of a single sheet of a material, having a shape corresponding to the frame, and arranged to tightly encompass the frame.

2. The toy bed as set forth in claim 1, wherein the tubes include straight and curved tubes of shorter and longer lengths.

3. The toy bed as set forth in claim 1, wherein the joints include straight joints, tee couplers, trident joints, cross joints, and quaternary joints.

4. The toy bed as set forth in claim 1, wherein the frame pushes the cover outwardly.

5. The toy bed as set forth in claim 1, wherein the cover is made of plastic leather.

6. The toy bed as set forth in claim 1, wherein the cover is made of leather.

7. The toy bed as set forth in claim 1, wherein the cover is made of cloth.

8. The toy bed as set forth in claim 1, wherein the cover has a design.

9. An assembled toy bed, which consists of a frame, a mattress and cover, the frame consisting of tubes and corresponding joints, each tube having two ends, the tubes including straight and curved tubes of shorter and longer lengths, and the joints including straight joints having two openings for receiving the ends of the tubes, tee couplers having three openings for receiving the ends of the tubes, trident joints having three openings for receiving the ends of the tubes, cross joints having four openings for receiving the ends of the tubes, and quaternary joints having four openings for receiving the ends of the tubes, the joints combining with the tubes to form a rigid three dimensional structure having a shape mimicking one of a locomotive, car, ship, submarine and tank, the mattress being tightly surrounded by the frame and stabilizing the frame, and the cover being made of a single sheet of a material with a design thereon, having a shape corresponding to the frame, and arranged to tightly encompass the frame, and the frame is arranged to push the cover outwardly.

* * * * *